US008276391B2

(12) United States Patent
Berry et al.

(10) Patent No.: US 8,276,391 B2
(45) Date of Patent: Oct. 2, 2012

(54) COMBUSTOR LINER COOLING AT TRANSITION DUCT INTERFACE AND RELATED METHOD

(75) Inventors: Jonathan Dwight Berry, Simpsonville, SC (US); Kara Johnston Edwards, Greer, SC (US); Heath Michael Ostebee, Piedmont, SC (US)

(73) Assignee: General Electric Company, Schenectady, NY (US)

( * ) Notice: Subject to any disclaimer, the term of this patent is extended or adjusted under 35 U.S.C. 154(b) by 204 days.

(21) Appl. No.: 12/762,842

(22) Filed: Apr. 19, 2010

(65) Prior Publication Data

US 2011/0252805 A1 Oct. 20, 2011

(51) Int. Cl.
*F02C 7/18* (2006.01)
*F23R 3/46* (2006.01)

(52) U.S. Cl. ..... 60/782; 60/752; 60/758; 60/760

(58) Field of Classification Search ..... 60/752, 60/755, 758, 760, 754, 772, 782, 39.37
See application file for complete search history.

(56) References Cited

U.S. PATENT DOCUMENTS

| | | | | |
|---|---|---|---|---|
| 4,527,397 | A * | 7/1985 | Tobery et al. | 60/757 |
| 4,719,748 | A * | 1/1988 | Davis et al. | 60/758 |
| 5,724,816 | A | 3/1998 | Ritter et al. | |
| 5,950,417 | A * | 9/1999 | Robertson et al. | 60/776 |
| 6,334,310 | B1 | 1/2002 | Sutcu et al. | |
| 6,427,446 | B1 | 8/2002 | Kraft et al. | |
| 6,595,745 | B1 | 7/2003 | Mohammed-Fakir et al. | |
| 6,860,098 | B2 * | 3/2005 | Suenaga et al. | 60/752 |
| 7,010,921 | B2 | 3/2006 | Intile et al. | |
| 7,082,766 | B1 | 8/2006 | Widener et al. | |
| 7,096,668 | B2 * | 8/2006 | Martling et al. | 60/757 |
| 7,269,957 | B2 | 9/2007 | Martling et al. | |
| 7,594,401 | B1 | 9/2009 | Chen et al. | |
| 2009/0120096 | A1 * | 5/2009 | Tuthill | 60/755 |
| 2009/0282833 | A1 * | 11/2009 | Hessler et al. | 60/757 |
| 2010/0077761 | A1 * | 4/2010 | Johnson et al. | 60/752 |

* cited by examiner

*Primary Examiner* — Ted Kim
(74) *Attorney, Agent, or Firm* — Nixon & Vanderhye, P.C.

(57) ABSTRACT

A resilient annular seal structure is disposed radially between an aft end portion of a combustor liner and a forward end portion of a transition piece, the resilient annular seal structure configured to form a first annular cavity radially between the forward end portion of the transition piece and the aft end portion of said combustor. At least one transfer tube radially extends from the second flow sleeve through the second flow annulus to the transition piece, and is arranged to supply compressor discharge cooling air radially from an area outside the first and second substantially axially extending flow annuli directly to the resilient annular seal structure and to the aft end of the combustor liner.

14 Claims, 11 Drawing Sheets

COMBUSTOR LINER COOLING AT TRANSITION DUCT INTERFACE AND RELATED METHOD

BACKGROUND OF THE INVENTION

This invention relates to internal cooling within a gas turbine engine, and more particularly, to an assembly for providing more efficient and uniform cooling in an interface or transition region between a combustor liner and a transition duct.

Traditional gas turbine combustors use diffusion (i.e., non-premixed) combustion in which fuel and air enter the combustion chamber separately. The process of mixing and burning produces flame temperatures exceeding 3900° F. Since conventional combustors and/or transition pieces (or ducts) having liners are generally capable of withstanding a maximum temperature on the order of only about 1500° F. for about ten thousand hours (10,000 hrs), steps to protect the combustor and/or transition piece must be taken. Typically, this has been done by a combination of impingement and film-cooling which involves introducing relatively cool compressor discharge air into a plenum formed by a flow sleeve surrounding the outside of the combustor liner. In this prior arrangement, the air from the plenum passes through apertures in the combustor liner and impinges on the exterior liner surface and then passes as a film over the outer or cold-side surface of the liner.

Because advanced combustors premix the maximum possible amount of air with the fuel for NOx reduction, however, little or no cooling air is available, thereby making film-cooling of the combustor liner and transition piece problematic. Nevertheless, combustor liners require active cooling to maintain material temperatures below limits. In dry low NOx (DLN) emission systems, this cooling can only be supplied as cold side convection. Such cooling must be performed within the requirements of thermal gradients and pressure loss. Thus, means such as thermal barrier coatings in conjunction with "backside" cooling have been considered to protect the combustor liner and transition piece from damage due to excessive heat. Backside cooling involves passing the compressor discharge air over the outer surface of the transition piece and combustor liner prior to premixing the air with the fuel.

With respect to the combustor liner, another current practice is to impingement cool the liner, or to provide turbulators on the exterior surface of the liner (see, for example, U.S. Pat. No. 7,010,921). Turbulation works by providing a blunt body in the flow which disrupts the flow creating shear layers and high turbulence to enhance heat transfer on the surface. Another practice is to provide an array of concavities on the exterior or outside surface of the liner (see, for example, U.S. Pat. No. 6,098,397). Dimple concavities function by providing organized vortices that enhance flow mixing and scrub the surface to improve heat transfer. The various known techniques enhance heat transfer but with varying effects on thermal gradients and pressure losses.

There remains a need for more efficient and more uniform cooling at the combustor liner/transition piece seal interface, and for minimizing leakage at the interface seal where cooling air is routed to the seal region from a higher-pressure location for the purpose of cooling the seal and adjourning components.

BRIEF DESCRIPTION OF THE INVENTION

The above-mentioned drawbacks (and others) are overcome or alleviated in example embodiments as broadly described below.

Thus, in one exemplary but nonlimiting embodiment, there is provided a combustor assembly for a turbine comprising a combustor including a combustor liner; a first flow sleeve surrounding the combustor liner forming a first substantially axially-extending flow annulus radially therebetween, the first flow sleeve having a first plurality of apertures formed about a circumference thereof for directing compressor discharge air as cooling air radially into the first flow annulus; a transition piece connected to the combustor liner, the transition piece adapted to carry hot combustion gases to the turbine; a second flow sleeve surrounding the transition piece forming a second substantially axially-extending flow annulus radially therebetween, the second flow sleeve having a second plurality of apertures for directing compressor discharge air as cooling air radially into the second flow annulus, the first substantially axially-extending flow annulus connecting with the second substantially axially-extending flow annulus; a resilient annular seal structure disposed radially between an aft end portion of the combustor liner and a forward end portion of the transition piece, the resilient annular seal structure configured to form a first annular cavity radially between the forward end portion of the transition piece and the aft end portion of the combustor liner; and at least one transfer tube radially extending from the second flow sleeve through the second flow annulus to the transition piece, and arranged to supply compressor discharge cooling air radially from an area outside the first and second substantially axially-extending flow annuli directly to the resilient annular seal structure and to the aft end of the combustor liner.

In another exemplary but nonlimiting aspect, there is provided a combustor assembly for a turbine comprising a combustor including a combustor liner; a first flow sleeve surrounding the combustor liner forming a first substantially axially-extending flow annulus radially therebetween, the first flow sleeve having a first plurality of apertures formed about a circumference thereof for directing compressor discharge air as cooling air radially into the first flow annulus; a transition piece connected to the combustor liner, the transition piece adapted to carry hot combustion gases to the turbine; a second flow sleeve surrounding the transition piece forming a second substantially axially-extending flow annulus radially therebetween, the second flow sleeve having a second plurality of apertures for directing compressor discharge air as cooling air radially into the second flow annulus, the first substantially axially-extending flow annulus connecting with the second substantially axially-extending flow annulus; a resilient annular seal structure disposed radially between an aft end portion of the combustor liner and a forward end portion of the transition piece; and means for supplying compressor discharge cooling air from a location external to the first and second flow sleeves directly to the resilient annular seal structure and an aft end portion of the combustor liner.

In still another exemplary but nonlimiting embodiment, there is provided a method of cooling an aft end portion of a gas turbine combustor liner and an annular seal structure radially interposed between the aft end portion of the gas turbine combustor liner and a transition piece adapted to supply combustion gases from the combustor liner to a first stage of the gas turbine, and wherein the combustor liner is connected to the transition piece, and a flow sleeve surrounding the combustor liner is connected to an impingement sleeve surrounding the transition piece thereby forming a cooling flow annulus, the method comprising supplying cooling air from a location external to the flow sleeve and the impingement sleeve directly to the annular seal structure and the aft end portion of the combustor liner; and thereafter directing at least a major portion of the cooling air into the cooling flow annulus.

The invention will now be disclosed in detail in connection with the drawings identified below.

DETAILED DESCRIPTION OF THE INVENTION

Figure 1:
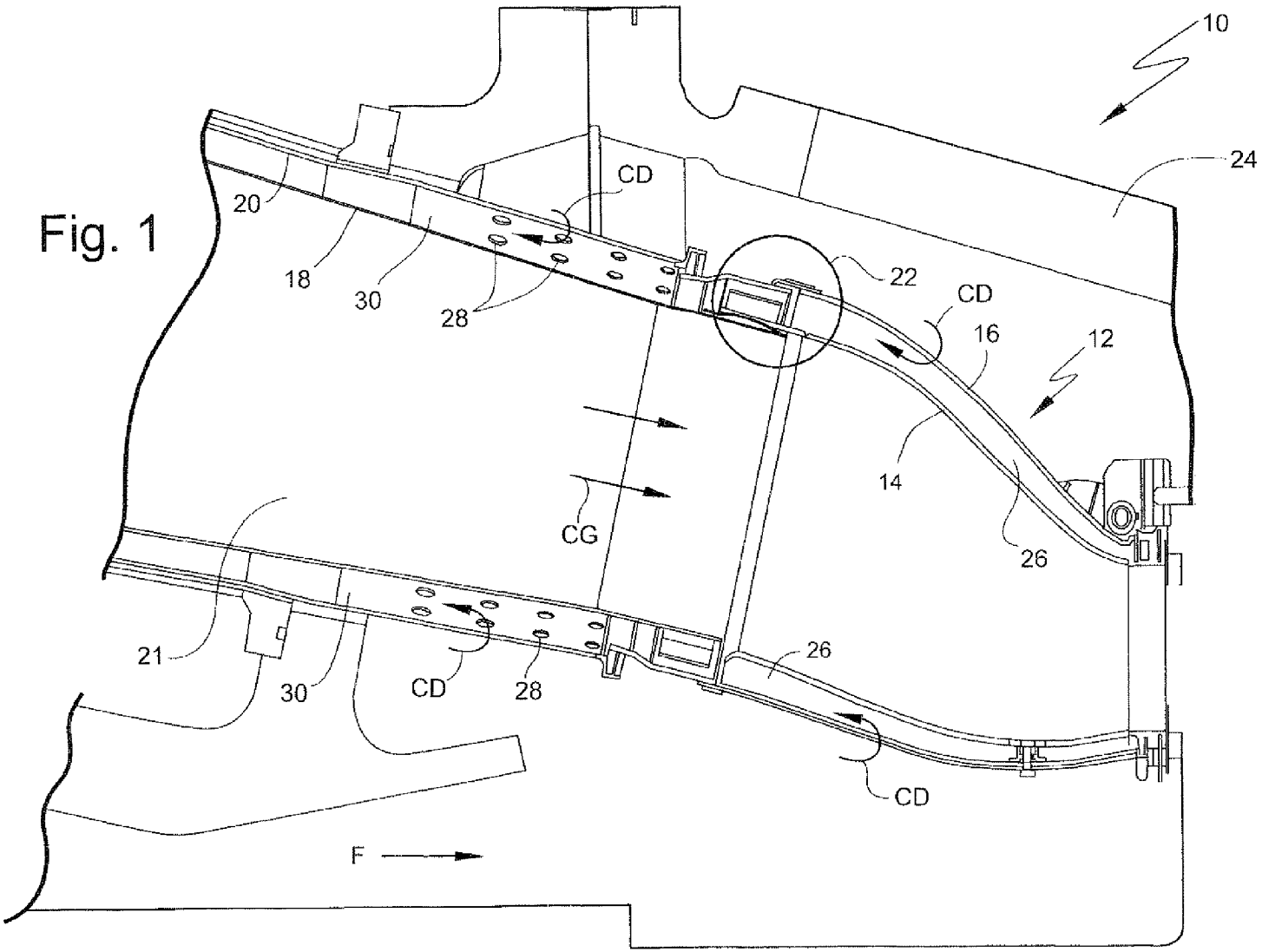
FIG. 1 is a partial schematic illustration of a gas turbine combustor section including a combustor liner/transition piece interface region.

FIG. 1 schematically depicts the aft end of a turbine combustor 10 and its connection to a transition piece or duct assembly 12 that directs the hot combustion gases to the first stage of the turbine. The transition piece assembly 12 includes a radially inner transition piece body (or simply, transition piece) 14 and an impingement sleeve (or second flow sleeve) 16 spaced radially outward of the transition piece 14. Upstream thereof (relative to the flow of combustion gases from the combustor to the turbine first stage, indicated by flow arrows CG) is the radially inner combustion liner 18 and its associated radially outer flow sleeve (or first flow sleeve) 20. The encircled region 22 is the transition piece/combustor liner interface that is of interest.

Flow from the gas turbine compressor (not shown) enters into the turbine or machine casing 24 as indicated by flow arrows F. About 50% of the so-called compressor discharge air passes radially through apertures (not shown in detail) formed along and about the impingement sleeve 16 as indicated by flow arrows CD. This air is reverse-flowed (i.e., toward the forward end of the combustor, counter to the flow of gases within the combustor liner and transition piece) in an annular region or passage 26 between the transition piece 14 and the impingement sleeve 16. The remaining approximately 50% of the compressor discharge air passes into holes 28 in the flow sleeve 20 and into an annular passage 30 between the flow sleeve 20 and the liner 18, where it mixes with the air flowing in the annular passage 26. The combined air from passages 26 and 30, used initially to cool the transition piece and combustor liner, eventually reverses direction again before entering the combustor liner where it mixes with the gas turbine fuel for burning in the combustion chamber 21.

Figure 2:
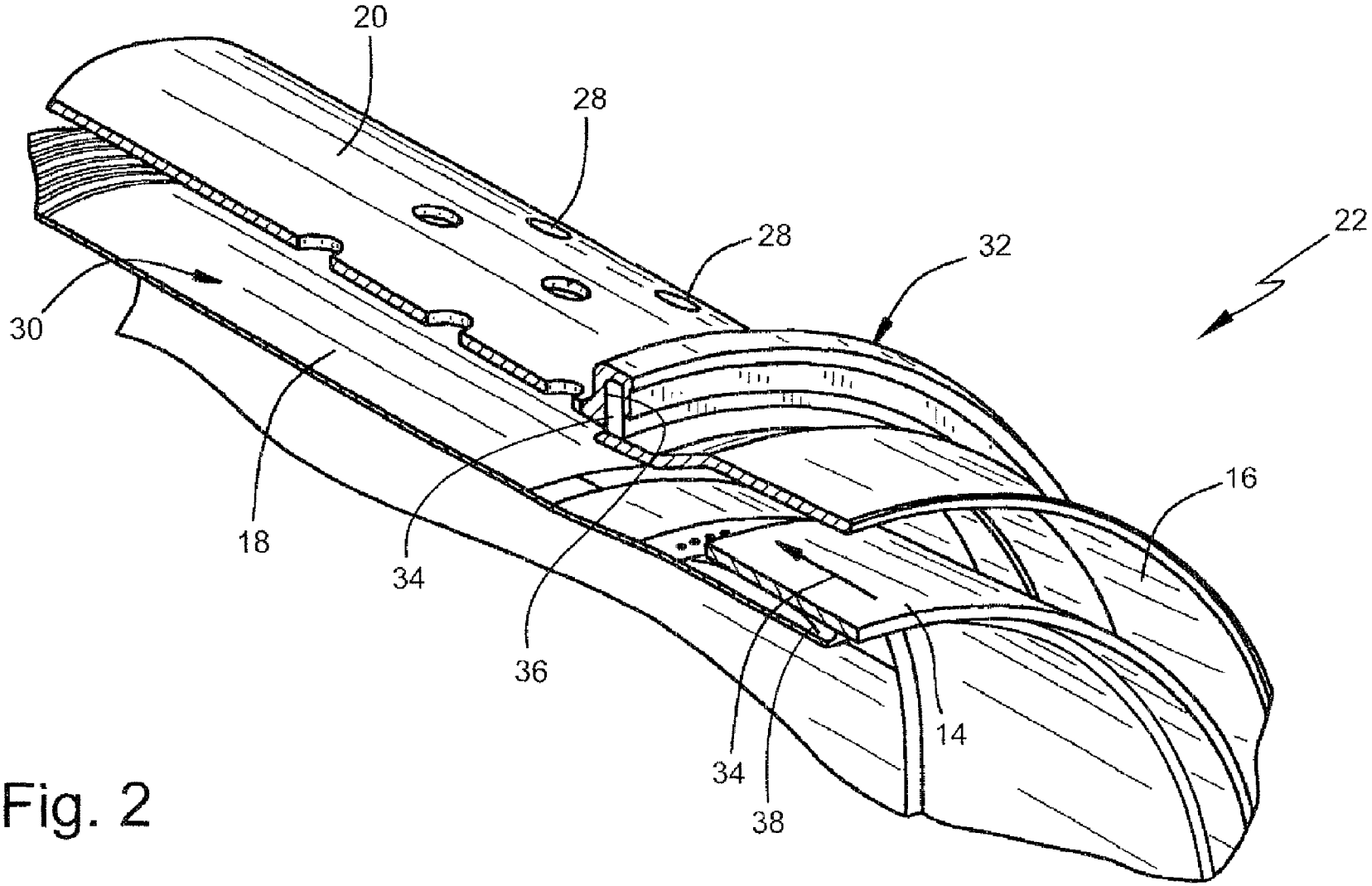
FIG. 2 is a partial but more detailed perspective of a combustor liner and flow sleeve joined to a transition piece and impingement sleeve with an annular seal located between the transition piece and combustor liner.

FIG. 2 illustrates an exemplary connection at an interface 22 between the transition piece 14/impingement sleeve 16, and the combustor liner 18/flow sleeve 20. The impingement sleeve 16 is joined to a mounting flange 32 on the aft end of the flow sleeve 20. Specifically, a radial outward piston seal 34 on the impingement sleeve 16 is received within a radially inward-facing annular groove 36 formed within the mounting flange 32. The transition piece receives the combustor liner 18 in a telescoping relationship with a conventional, annular compression-type or hula seal 38 interposed therebetween.

Figure 3:
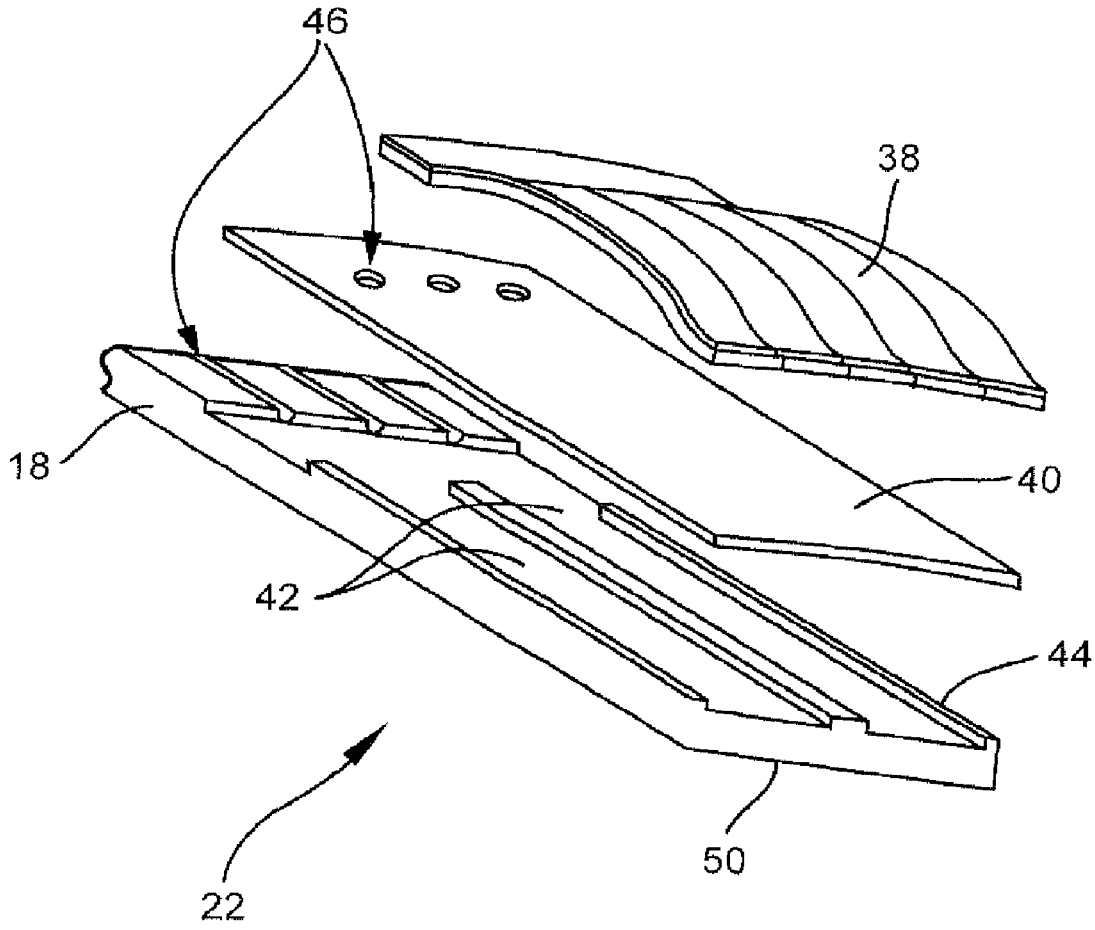
FIG. 3 is an exploded partial view, of the aft end of a conventional combustion liner illustrating a cooling arrangement for a combustor liner-transition piece hula seal.

Referring now to FIG. 3, a prior cooling arrangement in the area of the interface hula seal 38 was designed to cool the aft end 50 of the combustor liner 18. Specifically, the hula seal 38 is mounted radially between an annular cover plate 40 surrounding the liner aft end 50 and the transition piece 14 (see FIG. 2). More specifically, the cover plate 40 forms a mounting surface for the compression or hula seal 38. The aft end 50 of the liner 18 has a plurality of axial channels 42 formed by a plurality of axially-oriented raised sections or ribs 44 on the liner, closed on their radially outer sides by the plate 40. Cooling air from the passage 26 is introduced into the channels 42 through air inlet apertures or openings 46 in the cover plate 40 at the forward end of the channels. The air then flows into and through the channels 42 and exits at the aft end 50 of the liner 18 to join the combustion gases flowing into the transition piece. See commonly-owned U.S. Pat. No. 7,010,921 for additional details.

Figure 4:
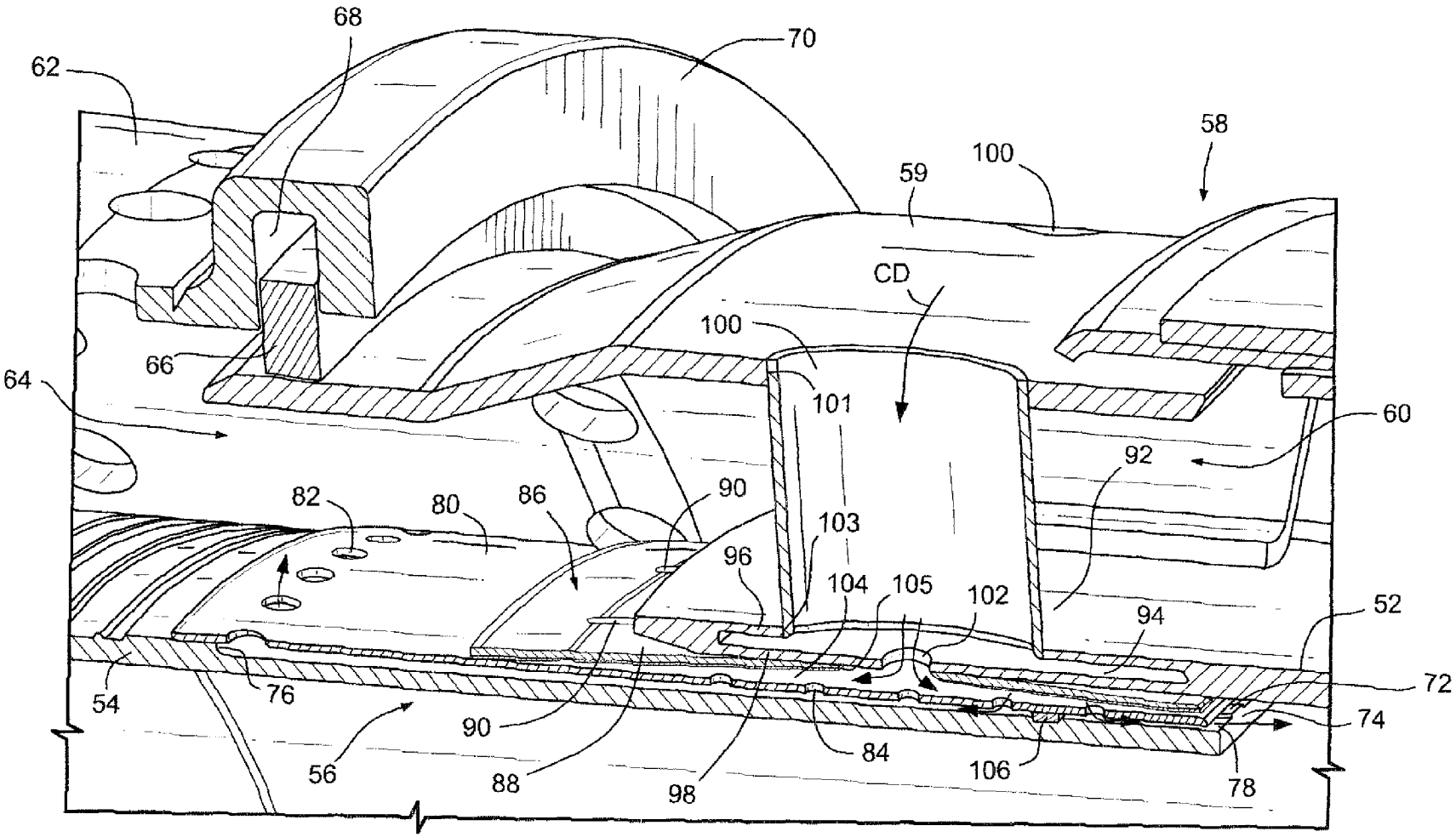
FIG. 4 is a partial perspective view, partially cut away, illustrating a cooling arrangement for a hula seal in accordance with an exemplary but nonlimiting embodiment of the invention.
Figure 5:
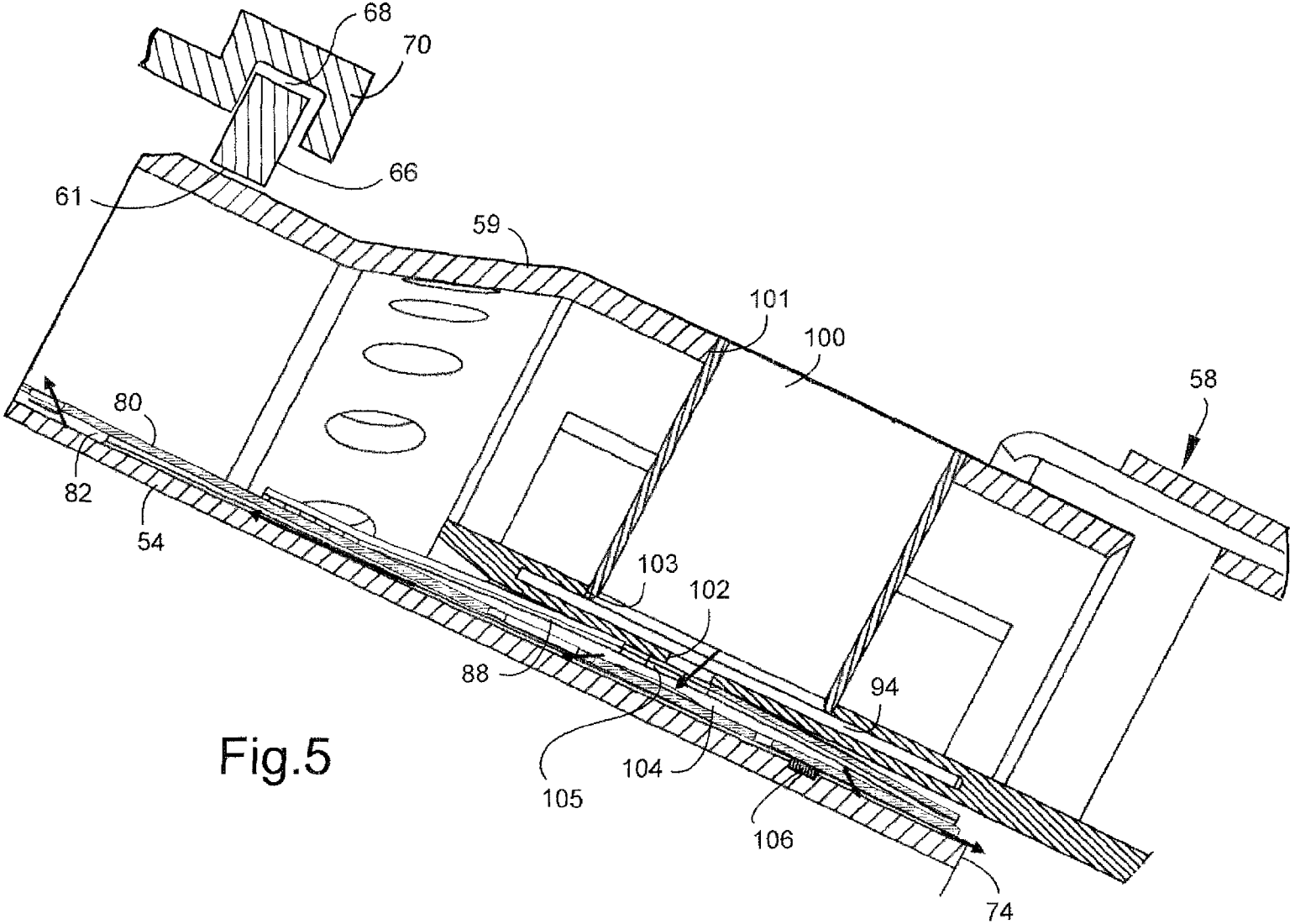
FIG. 5 is a cross-sectional elevational view of the arrangement shown in FIG. 4.

FIGS. 4 and 5 illustrate another combustor liner-transition piece interface that is similar in certain respects to those shown in FIGS. 2 and 3 but with modifications as explained below in accordance with a first exemplary but nonlimiting example of the invention.

In this first exemplary but nonlimiting embodiment, a transition piece 52 is connected to a combustor liner 54 at the aft end portion (or aft end) 56 of the liner. An impingement sleeve assembly 58 surrounds the transition piece 52 in radially-spaced relation thereto, forming a first annular flow passage 60. A flow sleeve 62 surrounds the combustor liner 54, also in radially spaced relation, thus forming a second annular flow passage 64 which is in direct flow communication with the first annular flow passage 60. The impingement sleeve assembly 58 is joined to the substantially axial flow sleeve 62 by means of a radially outwardly directed annular piston seal 66 which is received in a radially inwardly facing groove 68 in an annular flange 70 at the aft end of the flow sleeve. The piston seal 66 is composed of a split, annular ring (similar to a piston ring), biased radially inwardly to maintain a minimum gap between the radially inner seal edge 61 and the forward end of the impingement sleeve assembly (or, in the illustrated embodiment, the discrete coupling component 59 of the assembly 58).

The aft end 56 of the combustor liner 54 may be formed with an annular array of substantially axially-oriented ribs 72 extending between an aft edge 74 of the liner and an annular shoulder or edge 76, thus forming an array of axially-oriented channels 78 between respective rib pairs. The channels 78 are closed on their radially outer sides by an annular cover plate 80 that may be integral with or joined to (by welding, for example) the liner 54.

An annular row of cooling air exit holes 82 is provided at the forward end of the cover plate 80, adjacent the annular shoulder 76, and multiple annular rows or arrays of cooling air inlet holes 84 are provided nearer the aft end of the cover plate 80. It will be appreciated that the arrangement and number of exit apertures or holes 82, 84 may be varied as required by specific cooling applications.

A flexible, annular compression or hula seal 86 is telescoped over the aft end of the cover plate 80, the seal comprising plural axially-extending and circumferentially-spaced spring fingers 88, with axial slots 90 therebetween.

The forward end portion (or forward end) 92 of the transition piece 52 is formed to include an annular plenum chamber 94 between radially outer and inner wall portions 96, 98, respectively, of the transition piece body. Compressor discharge air external to the combustor (i.e. higher-pressure compressor air not flowing in the passages 60, 64) is supplied directly to the annular plenum chamber by means of a plurality of circumferentially-spaced transfer tubes 100 extending radially between apertures 101 formed in the impingement sleeve assembly 58 and radially-aligned apertures 103 formed in the transition piece 52. Note in this regard that the transfer tubes can be located within the discrete coupling component 59 of the transition piece assembly 58. Absent a discrete coupling component, the transfer tubes would extend from apertures formed in the impingement sleeve itself. The transfer tubes 100 may be varied in number and may have various cross-sectional shapes including round, oval, oblong, airfoil, etc.

Cooling air in the plenum 94 flows through circumferentially-spaced apertures 102 provided in the radially-inner wall portion 98 of the transition piece 52 and into an annular space or cavity 104 under the hula seal 86, via the axial slots 90 between the spring fingers 88 of the seal. Depending on the arrangement of transfer tubes and their position relative to the hula seal spring fingers 88, the slots 90 may not be available for supplying air to the cavity 104. In that case, discrete apertures 105 may be formed in the spring fingers 88. The cooling air is now free to flow through the cooling holes 84 in the aft end of the cover plate 80 and into the channels 78. Note, however, that the channels 78 are interrupted by one or more circumferentially extending ribs 106 located, in the exemplary embodiment, axially between the two rows of cooling holes 84 closer to the aft end of the hula seal 86 and the edge 74. As a result, the cooling air will flow in two opposite directions on either side of the one or more ribs 106. More specifically, the majority of the cooling air will flow toward the forward end of the combustor, exiting the apertures 82 and joining the air flowing in the passages 60, 64, while a minor portion of the cooling air will flow toward the aft end of the combustor, exiting the channels 78 at edge 74 and joining the flow of combustion gases within the liner and transition duct. The major flow of cooling air thus cools the hula seal 86 and impingement cools the cold side of the aft end of the liner while the minor portion of the cooling air purges the seal cavity 104, thus maintaining a flow of "fresh" cooling air through the cavity 104 and channels 78. Here again, the number of transfer tubes 100 and the number of apertures 102 (total number and number per transfer tube) may vary as required by cooling requirements as well as combustor design requirements. It may also be advantageous in some circumstances to provide turbulators on the surfaces defining the channels 78 to enhance cooling.

It will also be appreciated that by using discrete apertures 105 in the hula seal spring fingers 88, the flow of cooling air into the space or cavity 104 can be better controlled than if the elongated slots 90 used as conduits for the supply of cooling air to the cavity 104. Further in this regard, the apertures 105 may be sized and shaped to achieve optimum alignment with the apertures 102 when the components reach their maximum temperatures.

Thus, by having the major portion of the cooling flow eventually join the flow in passage 64 to the combustor nozzle and having only a minor portion of the cooling flow purge the seal and escape into the combustion gas stream, seal leakage is minimized and air available for premixing (and hence reduced emissions) is increased while maintaining cooling efficiency.

Figure 6:
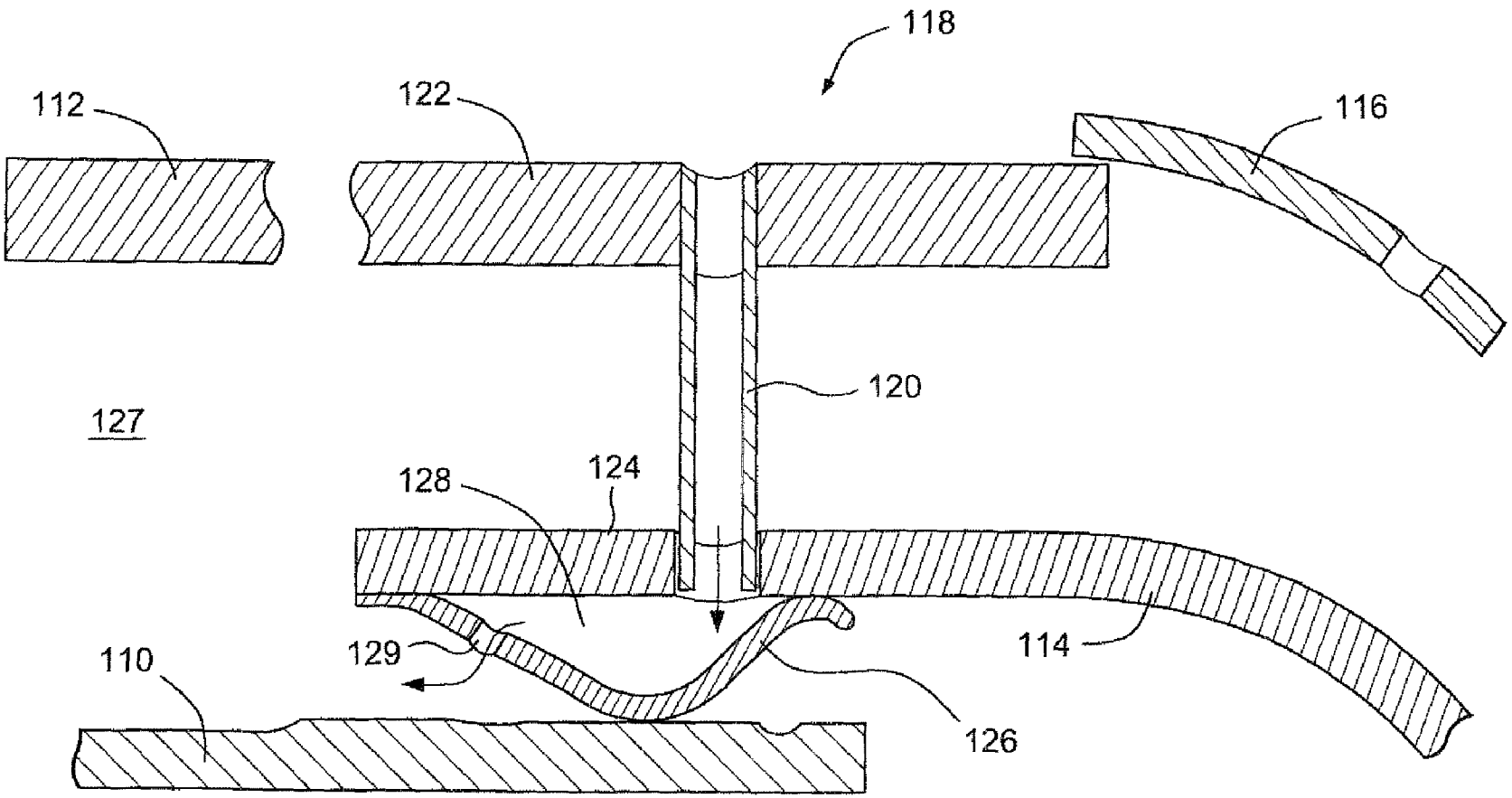
FIG. 6 is a simplified, partial section of a cooling arrangement in accordance with a second exemplary but nonlimiting embodiment.

FIG. 6 represents an alternative exemplary but nonlimiting embodiment, illustrated in simplified form. As in the previously described embodiment, a liner 110 and flow sleeve 112 are joined to a transition duct 114 and its impingement sleeve 116 at an interface 118. Circumferentially-spaced transfer tubes 120 extend radially between a coupling component 122 that joins the impingement sleeve 116 to the flow sleeve 112, and the transition piece forward end 124. In this embodiment, the hula seal 126 is inverted as compared to the arrangement in FIGS. 4 and 5, such that an annular space or cavity 128 is established radially outward of the seal 126. Higher-pressure cooling air entering the annular cavity 128 via the transfer tubes 120 flows out of the annular space 128 via apertures 129 in the spring fingers (or through the slots between the spring fingers), in a direction toward the forward end of the combustor, joining the cooling flow in the passage 127 (corresponding to passage 64 in FIGS. 4 and 5). Little to no cooling air escapes past the seal into the main combustion flow. In this embodiment, the seal 126 is impingement cooled and the interior cavity 128 is purged, but only marginal cooling of the aft end of the liner 110 is provided by convection cooling.

Figures 7, 7A:
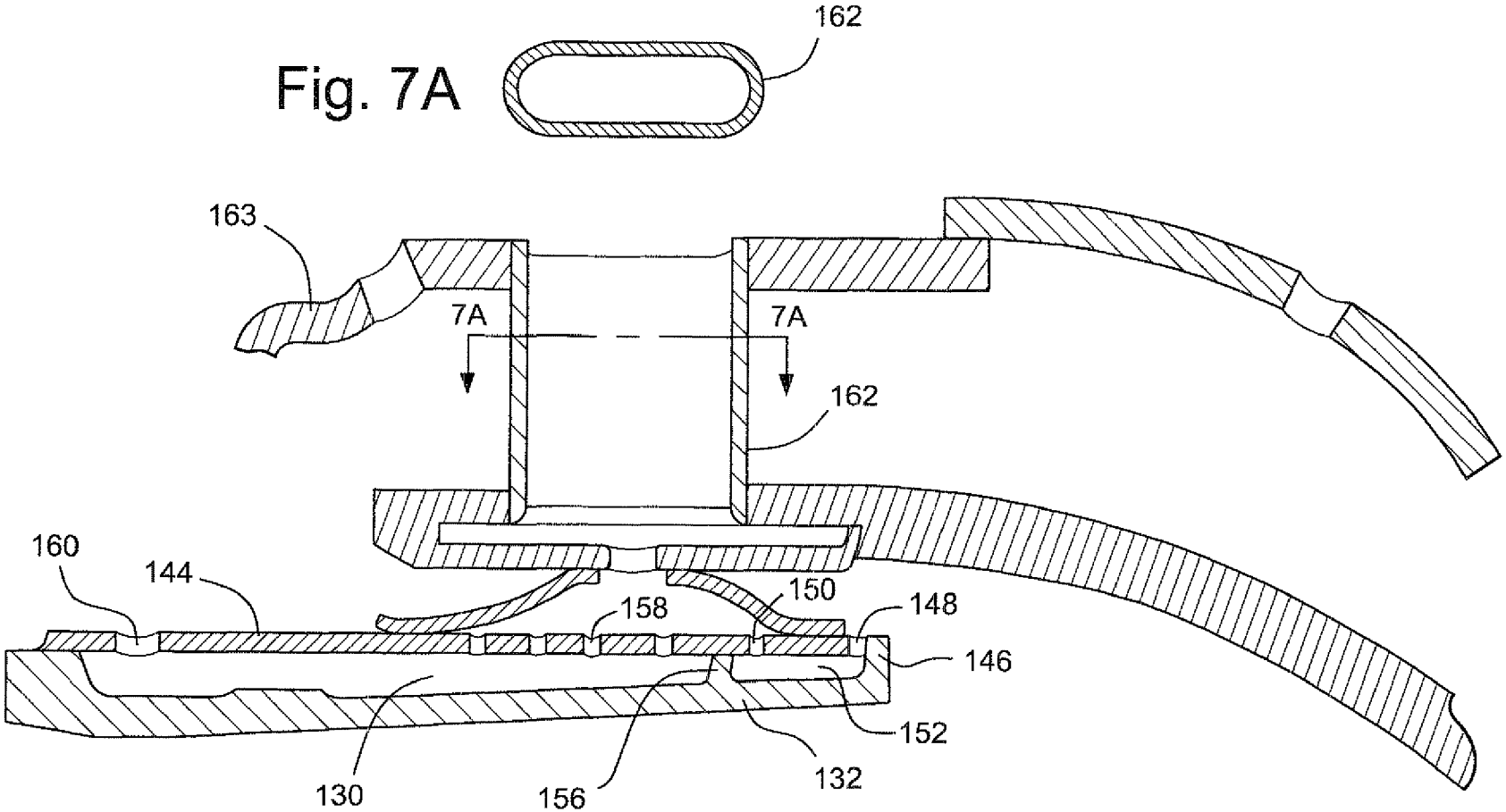
FIG. 7 is a simplified, partial section of a third cooling arrangement in accordance with another exemplary but nonlimiting embodiment.
FIG. 7A is a cross section taken along the line 7A-7A in FIG. 7.

FIGS. 7 and 7A illustrate an embodiment similar to that shown in FIGS. 4 and 5. In this alternative design, there are no ribs as shown at 72 in FIG. 4, and hence no discrete channels 78. Rather, a relatively smooth and continuous annular space or chamber 130 is formed radially between the aft end of the liner 132 and the annular cover plate 144. In addition, the liner 132 is formed with an upturned aft edge 146, defining in part the exit slots 148 for the minor portion of the purge air flowing through apertures 150 and the discrete annular chamber 152 (aft of the annular rib 156), subsequently exiting the slots 148 into the combustion gas stream. The major portion of cooling air flows through apertures 158 into the annular chamber 130 to impingement cool a portion of the aft end of the liner 132, while convection cooling the adjacent upstream portion and subsequently exiting apertures 160 to join the flow of air between the combustor flow sleeve 163 and the liner 132. FIG. 7A also illustrates a rounded, elongated cross-sectional shape for the transfer tube 162. Aside from these differences, the arrangement is otherwise substantially as shown and described above in connection with FIGS. 4 and 5. The configuration of chamber 130 may be tapered to expand the cooling flow at a lower pressure in the upstream direction.

Figure 8A:
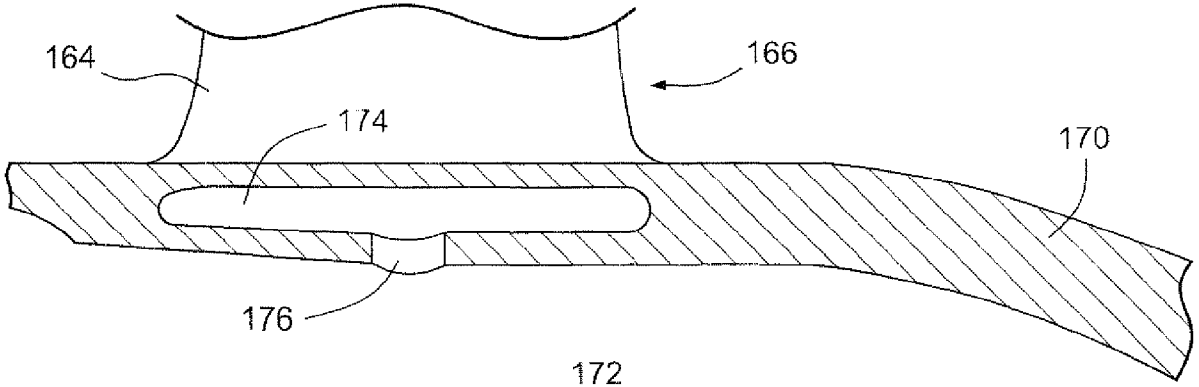
FIG. 8A is a partial section taken along the line 8A-8A in FIG. 8.
Figure 8:
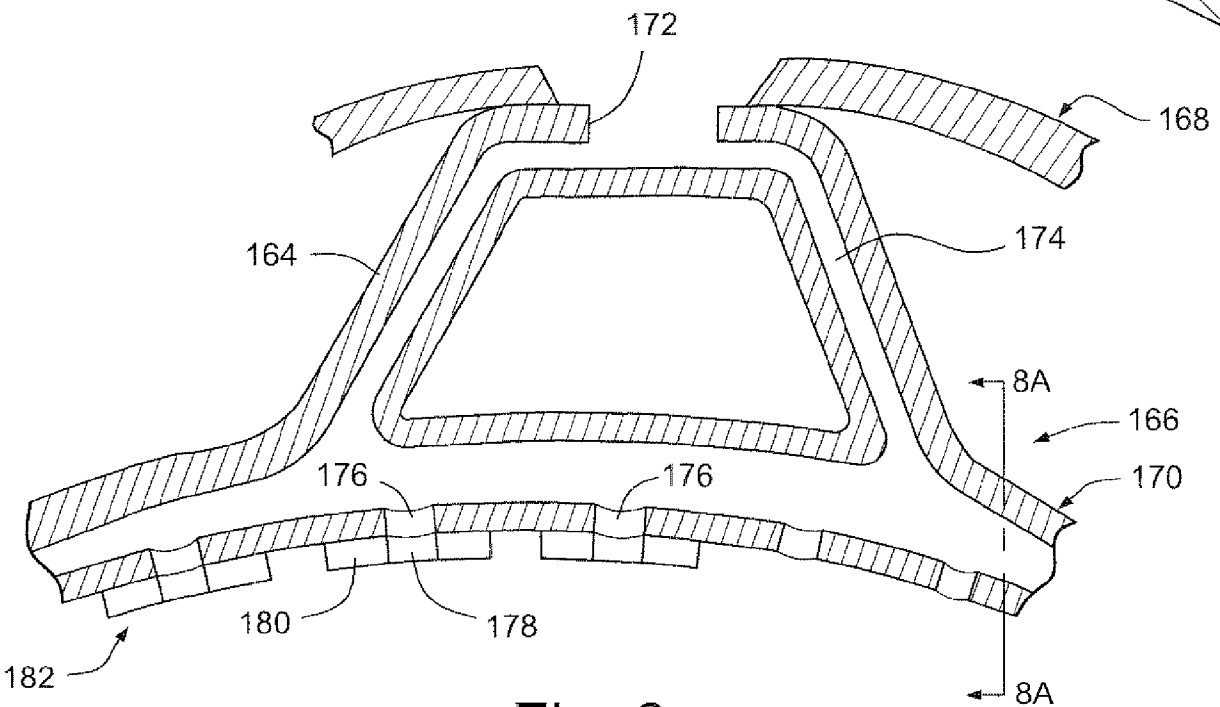
FIG. 8 is a simplified, partial section of a fourth cooling arrangement in accordance with another exemplary but nonlimiting embodiment.

FIGS. 8 and 8A illustrate yet another exemplary but nonlimiting embodiment. It will be appreciated that FIG. 8 is a section taken transverse to the longitudinal axis of the combustor. In this view, it can be appreciated that the transfer tubes 164 may be formed as an integral part (e.g., cast or otherwise suitably formed) of a respective plurality of radially-oriented structural supports 166 that extend between the impingement sleeve assembly 168 and the transition piece 170. The supports 166 are formed to include a radially inward inlet opening 172, radial passageway 174 and plural exit openings 176 that permit the cooling air to flow through aligned apertures 178 in the spring fingers 180 of the hula seal 182 (only partially shown) to thereby cool the area radially inward of the hula seal 182 substantially as described above.

Figure 9:
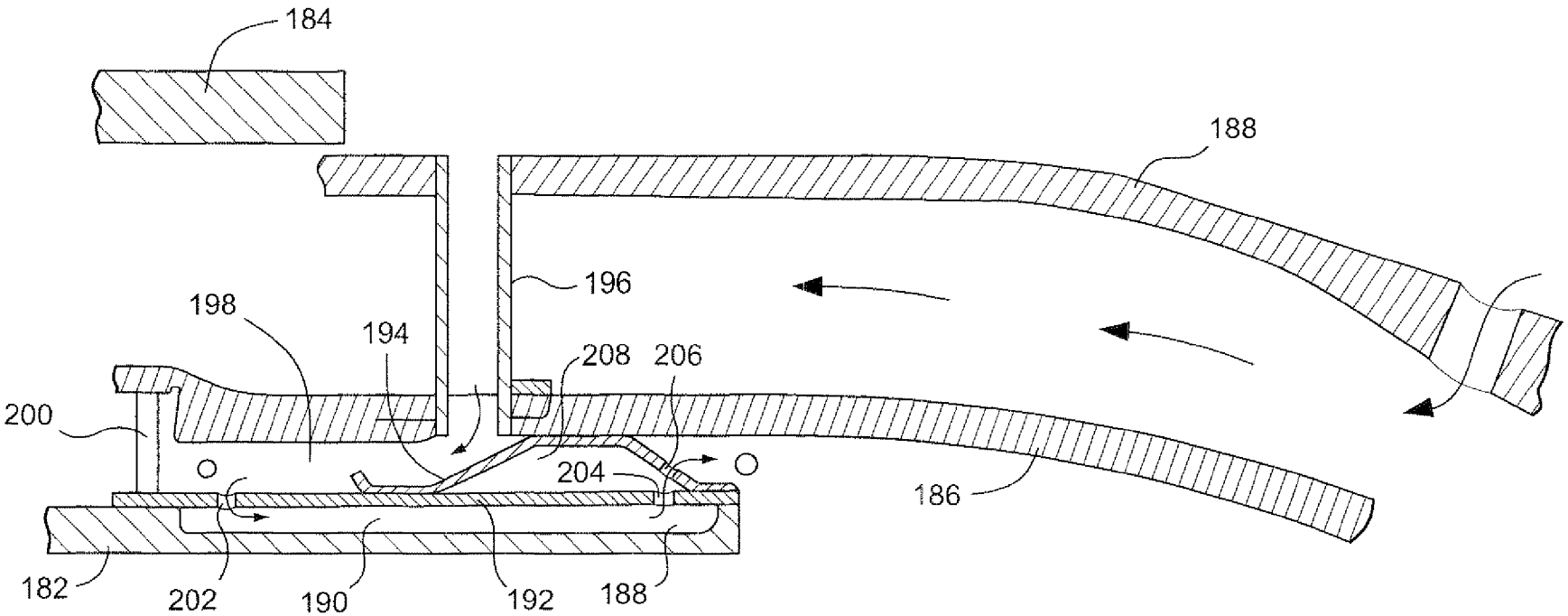
FIG. 9 is a simplified, partial section of a fifth cooling arrangement in accordance with another exemplary but nonlimiting embodiment.

Turning to FIG. 9, a simplified illustration of another cooling arrangement is provided. The combustor liner 182, flow sleeve 184, transition piece 186 and impingement sleeve 188 remain substantially as previously described. The aft end of the liner 182 is formed with an annular recess 190 closed on its radially outer side by an annular cover plate 192. The plate 192 supports the annular hula seal 194 extending radially between the aft end of the plate 192 and the transition piece 186. Each of the several transfer tubes 196 extends radially between the impingement sleeve 188 and the transition piece 186, supplying cooling air to an area 198 behind (i.e., toward the forward end of the hula seal 194). This area is sealed at its forward end by a second seal 200, forcing the cooling air to flow through the apertures 202 in the cover plate 192 and into the annular recess or chamber 190, exiting via the apertures 204 in the cover plate 192 at the aft end of the liner and apertures 206 in the hula seal 194. This arrangement cools the forward end of the hula seal by impingement cooling and cools the aft end of the liner by convection cooling while also purging the space 208 beneath the hula seal. The cooling air flow can be precisely controlled by optimizing the size, shape and number of transfer tubes 196, apertures 202 and apertures 204.

Figure 10:
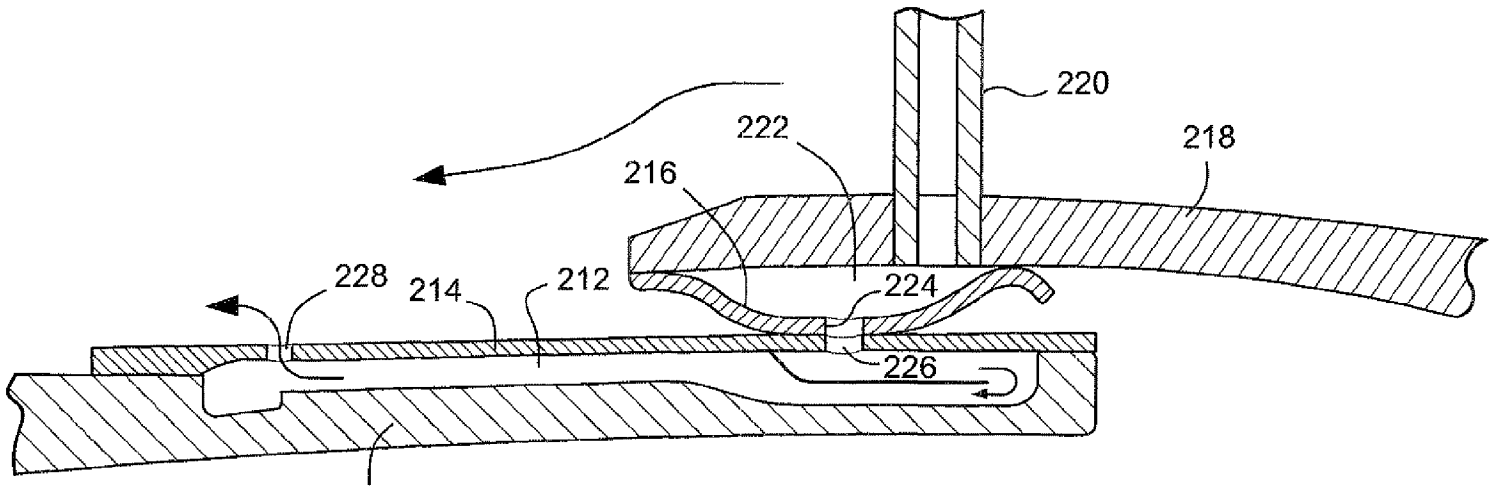
FIG. 10 is a simplified, partial section of a sixth cooling arrangement in accordance with another exemplary but nonlimiting embodiment.

FIG. 10 illustrates yet another exemplary but nonlimiting cooling arrangement. The combustor liner, flow sleeve, transition duct and impingement sleeve remain substantially as previously described. Note in this view, however, that the flow sleeve and impingement sleeve have been omitted. The aft end of the liner 210 is again formed with an annular recess 212 closed on its radially outward side by an annular cover plate 214, with an annular hula seal 216 extending radially between the aft end of the plate 214 and the transition piece 218. In this embodiment, the hula seal is again reversed or inverted relative to is orientation in, for example, FIG. 9. Cooling air from the compressor flows through the transfer tubes 220 and into the space 222 radially outward of the hula seal 216 to thereby impingement cool the seal. Cooling air then flows through apertures 224 in the spring fingers of the hula seal and through aligned apertures 226 in the cover plate, following a serpentine path into the annular recess 212. All of the cooling air flows from the aft end of the liner toward the forward end, substantially parallel to the flow of cooling air in the aligned passages between the transition duct and impingement sleeve on the one hand, and between the combustor liner and flow sleeve on the other. The cooling air exits the recess 212 via apertures 228 at the forward end of the cover plate and joins the flow of air in the aligned passages mentioned above. It will be appreciated that the air in space 222 is purged while the hula seal is impingement cooled, and the liner aft end is cooled primarily by convection cooling.

Figure 11:
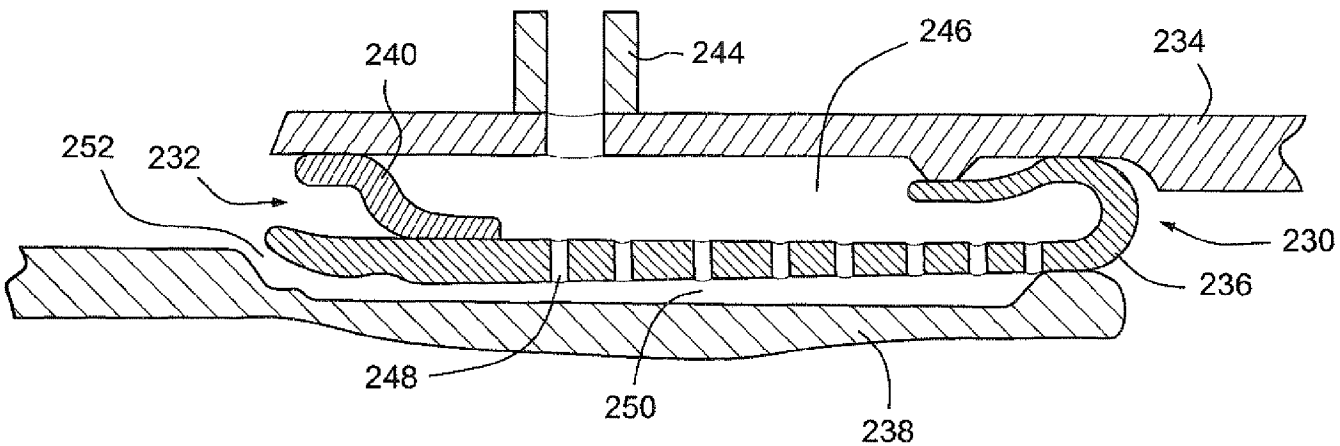
FIG. 11 is a simplified, partial section of a seventh cooling arrangement in accordance with another exemplary but nonlimiting embodiment.

FIG. 11 illustrates yet another cooling arrangement wherein a hula seal 230 is fixed at its forward end 232 to the transition piece 234, while an aft end 236 is resiliently compressed between the aft end of the liner 238 and the transition duct for movement relative thereto. The forward end 232 is fixed to the transition piece 234 preferably by welding, via a separate (shown) or integral (not shown) seal element 240. In this embodiment, the seal itself serves as an impingement plate, eliminating the need for a separate cover plate as shown, for example, at 214 in FIG. 10. Accordingly, cooling air flowing through the transfer tube 244 will flow into the cavity 246 to cool the seal, and then flow through apertures 248 in the seal into an area 250 radially below the seal, where it impingement cools the aft end of the liner 238. The cooling flow subsequently exits through the slot 252 at the forward end of the seal, joining the cooling air flowing in the radial passage between the flow sleeve and combustor liner to the combustors.

Figure 12:
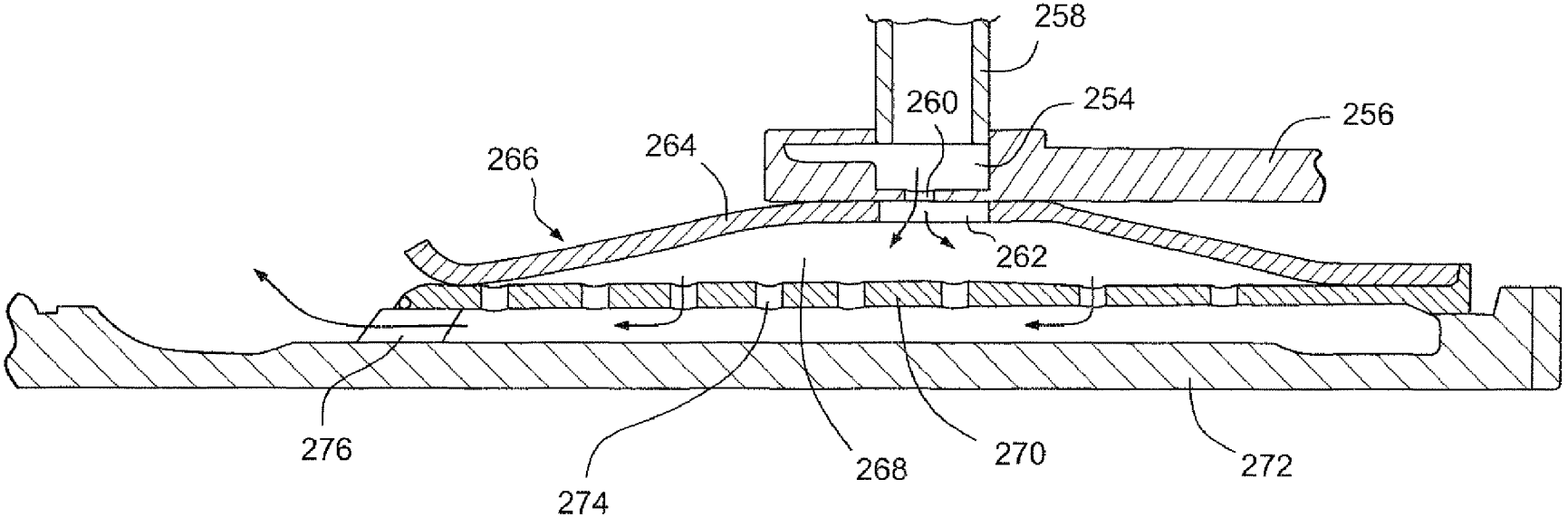
FIG. 12 is a simplified, partial section of an eighth cooling arrangement in accordance with another exemplary but nonlimiting embodiment.

Turning now to FIG. 12, an internal annular manifold 254 is formed at the aft end of the transition piece 256, receiving the cooling air from the transfer tubes 258. The manifold 254 supplies air through circumferentially-spaced apertures in the transition piece, and through aligned apertures 262 in the spring fingers 264 of the hula seal 266, into the area 268 radially between the hula seal 266 and a cover plate or sleeve 270 fixed to the liner 272. Air then flows through apertures 274 in the cover plate and exits at the forward end of the cover plate via slots 276, joining the flow in the annular passage between the liner and the flow sleeve.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

We claim:

1. A combustor assembly for a turbine comprising:

a combustor including a combustor liner;

a first flow sleeve surrounding said combustor liner forming a first substantially axially-extending flow annulus radially therebetween, said first flow sleeve having a first plurality of apertures formed about a circumference thereof for directing compressor discharge air as cooling air radially into said first flow annulus;

a transition piece connected to said combustor liner, said transition piece adapted to carry hot combustion gases to the turbine;

a second flow sleeve surrounding said transition piece forming a second substantially axially-extending flow annulus radially therebetween, said second flow sleeve having a second plurality of apertures for directing compressor discharge air as cooling air radially into said second flow annulus, said first substantially axially-extending flow annulus connecting with said second substantially axially-extending flow annulus;

a resilient annular seal structure disposed radially between an aft end of said combustor liner and a forward end of said transition piece, said resilient annular seal structure configured to form a first annular cavity radially between said forward end of said transition piece and said aft end of said combustor liner; and at least one transfer tube radially extending from said second flow sleeve through said second flow annulus to said transition piece, and arranged to supply compressor discharge cooling air radially from an area outside said first and second substantially axially-extending flow annuli directly to said resilient annular seal structure and to said aft end of said combustor liner; wherein said forward end of said transition piece is formed with a first annular cooling plenum, and wherein, in use, said at least one transfer tube supplies compressor discharge cooling air to said first annular cooling plenum which, in turn, supplies the compressor discharge cooling air to said resilient annular seal structure and to said aft end of said combustor liner.

2. The combustor assembly of claim 1 wherein said first annular cooling plenum is provided with plural, circumferentially-spaced cooling air exit apertures substantially radially aligned with said resilient annular seal structure.

3. The combustor assembly of claim 2 wherein said resilient annular seal structure comprises a hula seal having circumferentially-spaced spring fingers, said spring fingers formed with apertures therein aligned with said cooling air exit apertures, thereby permitting said cooling air to flow into said first annular cavity.

4. The combustor assembly of claim 3 wherein said aft end portion of said combustor liner is formed with an annular recess enclosed by an annular cover plate forming a second annular cavity, at least an aft end portion of said annular cover plate lying radially inward of said hula seal and said first annular cavity, said aft end portion of annular cover plate formed with a plurality of cooling air exit holes for supplying cooling air from said first annular cavity to said second annular cavity.

5. The combustor assembly of claim 4 wherein said second annular cavity is axially divided into forward and aft sections such that a minor portion of the cooling air is permitted to flow in a direction toward the turbine and a major portion of the cooling air is forced to flow in a direction toward the combustor.

6. The combustor assembly of claim 5 wherein a forward end of said annular cover plate is formed with exit apertures to allow said major portion of the cooling air in said forward section to exit said second annular cavity and flow into said first substantially axially-extending flow annulus.

7. A combustor assembly for a turbine comprising:

a combustor including a combustor liner;

a first flow sleeve surrounding said combustor liner forming a first substantially axially-extending flow annulus radially therebetween, said first flow sleeve having a first plurality of apertures formed about a circumference thereof for directing compressor discharge air as cooling air radially into said first flow annulus;

a transition piece connected to said combustor liner, said transition piece adapted to carry hot combustion gases to the turbine;

a second flow sleeve surrounding said transition piece forming a second substantially axially-extending flow annulus radially therebetween, said second flow sleeve having a second plurality of apertures for directing compressor discharge air as cooling air radially into said second flow annulus, said first substantially axially-extending flow annulus connecting with said second substantially axially-extending flow annulus;

a resilient annular seal structure disposed radially between an aft end portion of said combustor liner and a forward end portion of said transition piece; and means for supplying compressor discharge cooling air from a location external to said first and second flow sleeves directly to said resilient annular seal structure and an aft end portion of said combustor liner.

8. A method of cooling an aft end portion of a gas turbine combustor liner and an annular seal structure radially interposed between said aft end portion of said gas turbine combustor liner and a transition piece adapted to supply combustion gases from said combustor liner to a first stage of the gas turbine, and wherein said combustor liner is connected to said transition piece, and a flow sleeve surrounding said combustor liner is connected to an impingement sleeve surrounding said transition piece thereby forming a cooling flow annulus, the method comprising:

a. supplying cooling air from a location external to said flow sleeve and said impingement sleeve to resilient annular seal structure and said aft end portion of said combustor liner; and thereafter b. directing at least a major portion of the cooling air into said cooling flow annulus.

9. The method of claim 8 wherein a minor portion of said cooling air is directed into said transition piece.

10. The method of claim 8 wherein substantially all of said cooling air is directed into said cooling flow annulus.

11. The method of claim 8 wherein substantially all of said cooling air is directed into said transition piece.

12. The method of claim 8 wherein said annular seal structure comprises a hula seal having a plurality of resilient spring fingers in circumferentially-spaced relationship, said hula seal arranged to present a concave face thereof in a radially outward direction.

13. The method of claim 8 wherein the cooling air is supplied to a first annular cavity formed by said annular seal structure and then to a second annular cavity within said aft end of said combustor liner.

14. The method of claim 13 including dividing said second annular cavity such that a minor portion of the cooling air is directed into the transition piece.

* * * * *

UNITED STATES PATENT AND TRADEMARK OFFICE

CERTIFICATE OF CORRECTION

PATENT NO. : 8,276,391 B2
APPLICATION NO. : 12/762842
DATED : October 2, 2012
INVENTOR(S) : Berry et al.

It is certified that error appears in the above-identified patent and that said Letters Patent is hereby corrected as shown below:

Column 4, line 26, "The transition piece receives" should read --The transition piece 14 receives--

Column 5, line 1, insert --58-- after "the impingement sleeve assembly"

Column 5, line 29, insert --94-- after "directly to the annular plenum chamber"

Signed and Sealed this
Twelfth Day of February, 2013

Teresa Stanek Rea
*Acting Director of the United States Patent and Trademark Office*